US011196177B2

(12) United States Patent
Yamamoto

(10) Patent No.: US 11,196,177 B2
(45) Date of Patent: Dec. 7, 2021

(54) ANTENNA-MOUNTED SUBSTRATE AND ANTENNA MODULE

(71) Applicant: Murata Manufacturing Co., Ltd., Kyoto (JP)

(72) Inventor: Issei Yamamoto, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 10 days.

(21) Appl. No.: 16/867,140

(22) Filed: May 5, 2020

(65) Prior Publication Data

US 2020/0266549 A1 Aug. 20, 2020

Related U.S. Application Data

(63) Continuation of application No. PCT/JP2018/038077, filed on Oct. 12, 2018.

(30) Foreign Application Priority Data

Nov. 6, 2017 (JP) ..... JP2017-213793

(51) Int. Cl.
*H01Q 1/22* (2006.01)
*H01Q 21/06* (2006.01)
(Continued)

(52) U.S. Cl.
CPC ..... *H01Q 21/06* (2013.01); *H01Q 1/22* (2013.01); *H01Q 1/48* (2013.01); *H01Q 9/0407* (2013.01)

(58) Field of Classification Search
CPC .. H01Q 21/06; H01Q 1/22; H01Q 1/38–1/48; H01Q 9/0407
See application file for complete search history.

(56) References Cited

U.S. PATENT DOCUMENTS 6,211,824 B1 4/2001 Holden et al.
2006/0139209 A1* 6/2006 Tanaka ..... H01Q 19/22 343/700 MS
(Continued)

FOREIGN PATENT DOCUMENTS

JP S60-158307 U 10/1985
JP H09-98016 A 4/1997
(Continued)

OTHER PUBLICATIONS

International Search Report issued in Patent Application No. PCT/JP2018/038077 dated Dec. 18, 2018.
(Continued)

*Primary Examiner* — Hasan Islam
(74) *Attorney, Agent, or Firm* — Pearne & Gordon LLP

(57) ABSTRACT

An antenna-mounted substrate includes a first patch antenna, a second patch antenna disposed to face one principal surface of the first patch antenna, and a ground electrode disposed to face the other principal surface of the first patch antenna, the antenna-mounted substrate further including an antenna holding layer holding the second patch antenna, an inter-antenna layer positioned between the first patch antenna and the second patch antenna, and a substrate layer positioned between the first patch antenna and the ground electrode, those three layers being positioned in the mentioned order, wherein the inter-antenna layer is made of a dielectric material, and a relation of $\varepsilon_{r3}>\varepsilon_{r1}\geq\varepsilon_{r2}$ is satisfied on an assumption that a relative permittivity of the antenna holding layer is denoted by $\varepsilon_{r1}$, a relative permittivity of the inter-antenna layer is denoted by $\varepsilon_{r2}$, and a relative permittivity of the substrate layer is denoted by $\varepsilon_{r3}$.

11 Claims, 2 Drawing Sheets

(51) Int. Cl.
*H01Q 1/48* (2006.01)
*H01Q 9/04* (2006.01)

(56) References Cited

U.S. PATENT DOCUMENTS

| | | | | |
|---|---|---|---|---|
| 2009/0289852 | A1 | 11/2009 | Li et al. | |
| 2016/0049723 | A1* | 2/2016 | Baks ..... | H01Q 1/2291 343/848 |
| 2017/0229784 | A1 | 8/2017 | Kitamura et al. | |

FOREIGN PATENT DOCUMENTS

| | | | |
|---|---|---|---|
| JP | H09-275317 | A | 10/1997 |
| JP | 2009-188895 | A | 8/2009 |
| JP | 2012-235351 | A | 11/2012 |
| JP | 2013-519275 | A | 5/2013 |
| WO | 2011-095144 | A1 | 8/2011 |
| WO | 2016-067906 | A1 | 5/2016 |

OTHER PUBLICATIONS

Written Opinion issued in Patent Application No. PCT/JP2018/038077 dated Dec. 18, 2018.

* cited by examiner

ANTENNA-MOUNTED SUBSTRATE AND ANTENNA MODULE

This is a continuation of International Application No. PCT/JP2018/038077 filed on Oct. 12, 2018 which claims priority from Japanese Patent Application No. 2017-213793 filed on Nov. 6, 2017. The contents of these applications are incorporated herein by reference in their entireties.

BACKGROUND OF THE DISCLOSURE

Field of the Disclosure

The present disclosure relates to an antenna-mounted substrate and an antenna module.

Description of the Related Art

As an example of structure of an antenna-mounted substrate including one antenna arranged above the other antenna, Patent Document 1 discloses a structure in which a dielectric separator is present between a lower antenna element and an upper antenna element and the dielectric separator includes a cavity.

Patent Document 1: Japanese Unexamined Patent Application Publication (Translation of PCT Application) No. 2013-519275

BRIEF SUMMARY OF THE DISCLOSURE

Patent Document 1 states that a relative permittivity between the antenna elements is reduced with the cavity formed in the dielectric separator and hence antenna characteristics can be improved.

However, the presence of the cavity between the antenna elements may accompany with a possibility that, because the rigidity of a substrate decreases, the distance between the antenna elements cannot be kept stably and the antenna characteristics become unstable. Furthermore, if the upper antenna element is deformed to the projecting side, the antenna characteristics degrade, and it is difficult to realize the reduction in the thickness of the substrate.

The present disclosure has been made with intent to solve the above-described problem, and an object of the present disclosure is to provide an antenna-mounted substrate in which a relative permittivity between antennas is reduced, the rigidity of the substrate is ensured, and the reduction in the thickness can be realized. Another object of the present disclosure is to provide an antenna module in which an electronic component is mounted to the antenna-mounted substrate.

An antenna-mounted substrate according to the present disclosure includes a first patch antenna, a second patch antenna disposed to face one principal surface of the first patch antenna, and a ground electrode disposed to face the other principal surface of the first patch antenna. The antenna-mounted substrate according to the present disclosure further includes an antenna holding layer that holds the second patch antenna, an inter-antenna layer that is positioned between the first patch antenna and the second patch antenna, and a substrate layer that is positioned between the first patch antenna and the ground electrode, those three layers being positioned in the mentioned order. A relation of $\varepsilon_{r3}>\varepsilon_{r1}\geq\varepsilon_{r2}$ is satisfied on an assumption that a relative permittivity of the antenna holding layer is denoted by $\varepsilon_{r1}$, a relative permittivity of the inter-antenna layer is denoted by $\varepsilon_{r2}$, and a relative permittivity of the substrate layer is denoted by $\varepsilon_{r3}$.

In a first embodiment of the present disclosure, the inter-antenna layer is made of a dielectric material.

Preferably, the dielectric material is a resin material.

In a second embodiment of the present disclosure, the inter-antenna layer has a cavity portion and a support portion, and when viewed in a section perpendicular to a thickness direction of the inter-antenna layer, the support portion divides the cavity portion into a plurality of regions or is disposed as a plurality of support portions scattered in the cavity portion.

Preferably, when viewed in the section perpendicular to the thickness direction of the inter-antenna layer, the support portion has a honeycomb shape dividing the cavity portion into the plurality of regions.

Preferably, the support portion is made of a ceramic material. It is also preferable that the support portion is made of a resin material.

An antenna module according to the present disclosure includes an antenna-mounted substrate in which an antenna is mounted to one principal surface of a circuit substrate, and an electronic component mounted to the antenna-mounted substrate, wherein the antenna-mounted substrate is the antenna-mounted substrate according to the present disclosure.

Preferably, the electronic component is mounted to the other principal surface of the circuit substrate.

According to the present disclosure, the antenna-mounted substrate can be obtained in which the relative permittivity between the antennas is reduced, the rigidity of the substrate is ensured, and the reduction in the thickness can be realized.

DETAILED DESCRIPTION OF THE DISCLOSURE

An antenna-mounted substrate and an antenna module according to the present disclosure will be described below.

However, the present disclosure is not limited to the following embodiments and can be put into practice in forms modified as appropriate insofar as not departing from the gist of the present disclosure. Modifications obtained by combining two or more among individual desired features of the present disclosure, described below, also fall within the scope of the present disclosure.

It is needless to say that the following embodiments are merely illustrative, and the features of the different embodiments can be partly replaced or combined with each other. In the second and subsequent embodiments, the description of similar matters to those in the first embodiment is omitted and only different points are described. In particular, similar advantageous effects obtained with similar features are not repeatedly described for each of the embodiments.

First Embodiment

[Antenna-Mounted Substrate]

An antenna-mounted substrate according to a first embodiment of the present disclosure will be described below.

In the first embodiment of the present disclosure, an inter-antenna layer is made of a dielectric material.

Figure 1:
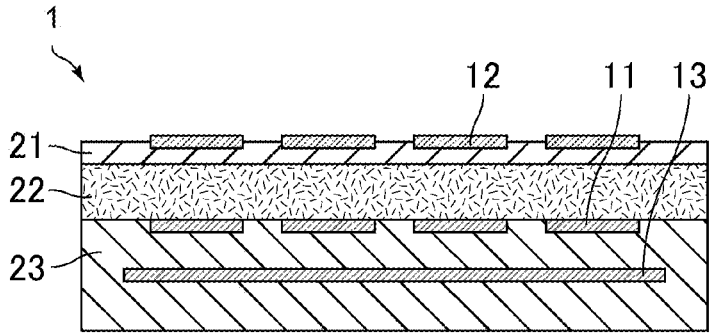
FIG. 1 is a sectional view schematically illustrating an example of an antenna-mounted substrate according to a first embodiment of the present disclosure.

FIG. 1 is a sectional view schematically illustrating an example of an antenna-mounted substrate according to the first embodiment of the present disclosure.

The antenna-mounted substrate 1 illustrated in FIG. 1 includes a first patch antenna 11, a second patch antenna 12, and a ground electrode 13. The second patch antenna 12 is disposed to face one principal surface (upper principal surface in FIG. 1) of the first patch antenna 11, and the ground electrode 13 is disposed to face the other principal surface (lower principal surface in FIG. 1) of the first patch antenna 11.

The antenna-mounted substrate 1 illustrated in FIG. 1 further includes an antenna holding layer 21 that holds the second patch antenna 12, an inter-antenna layer 22 that is positioned between the first patch antenna 11 and the second patch antenna 12, and a substrate layer 23 that is positioned between the first patch antenna 11 and the ground electrode 13, those three layers being positioned in the mentioned order.

Although not illustrated in FIG. 1, various wirings are formed in the antenna-mounted substrate 1 as required.

In the antenna-mounted substrate 1 illustrated in FIG. 1, the first patch antenna 11 and the second patch antenna 12 are each constituted by a plurality of patterns, but the patch antenna may be constituted by one pattern. In either case, it is preferable that the first patch antenna 11 and the second patch antenna 12 are arranged to overlap with each other in a thickness direction (up-down direction in FIG. 1).

While, in FIG. 1, the first patch antenna 11 is partly buried in a surface layer of the substrate layer 23, an additional thin substrate layer 23 may be disposed on the first patch antenna 11 for protection of the first patch antenna 11 during the movement of the substrate. On the other hand, the ground electrode 13 is disposed inside the substrate layer 23, and a part of the substrate layer 23 is further positioned on one side of the ground electrode 13 opposite to the first patch antenna 11.

Moreover, as illustrated in FIG. 1, the antenna holding layer 21 may be present between the second patch antenna 12 and the inter-antenna layer 22. The second patch antenna 12 may be disposed on the surface of the antenna holding layer 21 or inside the antenna holding layer 21. When the second patch antenna 12 is disposed inside the antenna holding layer 21, the surface of the second patch antenna 12 can be protected from being damaged in a mounting step.

In the antenna-mounted substrate according to the first embodiment of the present disclosure, the inter-antenna layer is made of a dielectric material, and a relation of $\varepsilon_{r3}>\varepsilon_{r1}\geq\varepsilon_{r2}$ is satisfied on an assumption that a relative permittivity of the antenna holding layer is denoted by $\varepsilon_{r1}$, a relative permittivity of the inter-antenna layer is denoted by $\varepsilon_{r2}$, and a relative permittivity of the substrate layer is denoted by $\varepsilon_{r3}$.

In the first embodiment of the present disclosure, antenna characteristics can be improved by setting the relative permittivity of the inter-antenna layer positioned between the first patch antenna and the second patch antenna to be relatively minimal. In the first embodiment, since a layer made of a low permittivity is interposed between the antennas, the rigidity of the substrate can be ensured while the relative permittivity of the inter-antenna layer is reduced. As a result, the antenna characteristics can be stabilized, and a warp of the substrate can be suppressed.

Furthermore, by setting the relative permittivity of the substrate layer positioned between the first patch antenna and the ground electrode to be relatively maximal, the desired characteristic impedance can be obtained even when the thickness of the substrate layer is reduced. As a result, the thickness of the antenna-mounted substrate can be reduced.

In the first embodiment of the present disclosure, a relation of $\varepsilon_{r3}>\varepsilon_{r1}>\varepsilon_{r2}$ may be satisfied, or a relation of $\varepsilon_{r3}>\varepsilon_{r1}=\varepsilon_{r2}$ may be satisfied.

In the first embodiment of the present disclosure, the relative permittivity $\varepsilon_{r1}$ of the antenna holding layer is preferably not less than 3 and not more than 10.

In the first embodiment of the present disclosure, a material constituting the antenna holding layer may be, for example, a resin material used to form a general printed board.

In the first embodiment of the present disclosure, the thickness of the antenna holding layer is not limited to a particular value and is, for example, not less than 5 μm and not more than 50 μm. The thickness of the antenna holding layer is preferably not less than 15 μm and not more than 30 μm and more preferably not less than 20 μm and not more than 30 μm.

In the first embodiment of the present disclosure, the relative permittivity $\varepsilon_{r2}$ of the inter-antenna layer is preferably not less than 1.5 and not more than 3 and more preferably not less than 1.5 and less than 3.

In the first embodiment of the present disclosure, the dielectric material constituting the inter-antenna layer is preferably a resin material. Examples of such a resin material include fluororesin, silicone rubber, and hydrocarbon resins each having a small number of polar groups (such as polyethylene, polypropylene, and polystyrene). More preferable practical examples are fluororesin with $\varepsilon_r\approx2.6$, silicone rubber with $\varepsilon_r\approx3.0$, polyethylene with $\varepsilon_r\approx2.25$, polypropylene with $\varepsilon_r\approx2.2$, and polystyrene with $\varepsilon_r\approx2.45$. Here, $\varepsilon_r$ denotes a relative permittivity.

In the first embodiment of the present disclosure, the thickness of the inter-antenna layer is not limited to a particular value, but it is preferably not less than 150 μm and not more than 250 μm.

In the first embodiment of the present disclosure, the relative permittivity $\varepsilon_{r3}$ of the substrate layer is preferably not less than 5 and not more than 20 and more preferably more than 10 and not more than 20.

In the first embodiment of the present disclosure, a material constituting the substrate layer may be, for example, any of low temperature co-fired ceramic (LTCC) materials. The low temperature co-fired ceramic materials refer to those ones of ceramic materials, which can be sintered at firing temperature of 1000° C. or below and which can be co-fired with copper, silver, or the like.

The low temperature co-fired ceramic materials are, for example, glass-composite low temperature co-fired ceramic materials obtained by mixing borosilicate glass into ceramic materials such as quartz, alumina, and forsterite, crystallized-glass low temperature co-fired ceramic materials using $ZnO—MgO—Al_2O_3—SiO_2$ crystallized glass, and non-glass low temperature co-fired ceramic materials using $BaO—Al_2O_3—SiO_2$ ceramic materials or $Al_2O_3—CaO—SiO_2—MgO—B_2O_3$ ceramic materials.

In the first embodiment of the present disclosure, the thickness of the substrate layer is not limited to a particular value, but the thickness of the substrate layer positioned between the first patch antenna and the ground electrode is preferably not less than 30 μm and not more than 90 μm.

[Antenna Module]

An antenna module according to the first embodiment of the present disclosure includes an antenna-mounted substrate and an electronic component mounted to the antenna-mounted substrate, the antenna-mounted substrate being the same as that according to the first embodiment of the present disclosure.

Figure 2:
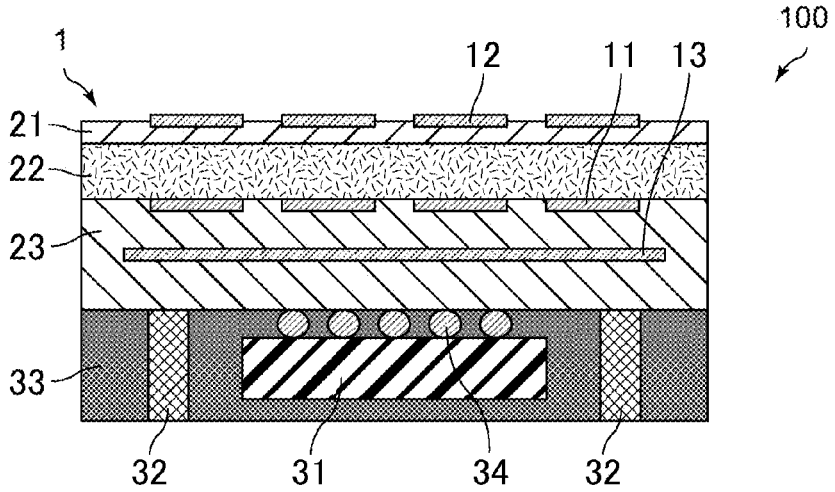
FIG. 2 is a sectional view schematically illustrating an example of an antenna module according to the first embodiment of the present disclosure.

FIG. 2 is a sectional view schematically illustrating an example of the antenna module according to the first embodiment of the present disclosure.

The antenna module 100 illustrated in FIG. 2 includes an antenna-mounted substrate 1 in which an antenna is mounted to one principal surface of a circuit substrate, and an electronic component 31 mounted to the antenna-mounted substrate 1. The antenna-mounted substrate 1 is constituted as per described with reference to FIG. 1.

In the antenna module 100 illustrated in FIG. 2, the electronic component 31 is mounted to the other principal surface of the circuit substrate, i.e., a principal surface on the opposite side to the principal surface to which the antenna is mounted. The electronic component 31 is mounted to the circuit substrate with a bonding material 34, such as a solder, interposed therebetween.

In the antenna module 100 illustrated in FIG. 2, outer terminals 32 are disposed on the other principal surface of the circuit substrate, and the electronic component 31 and the outer terminals 32 are sealed by an sealing material 33.

Examples of the electronic component 31 include an integrated circuit (IC) and surface mount components (SMC) such as various passive components (including a capacitor, an inductor, and a resistance). From the viewpoint of increasing an effective area of the antenna, the electronic component is preferably mounted to the other principal surface of the circuit substrate.

As with the electronic component, the outer terminals are preferably mounted to the other principal surface of the circuit substrate.

The above-described antenna module can be used, by way of example, for high-speed communication in mobile devices.

The antenna-mounted substrate and the antenna module according to the first embodiment of the present disclosure are preferably manufactured as follows.

(1) The second patch antenna and the antenna holding layer are fabricated.

For example, a copper foil which will constitute the second patch antenna is laminated on the antenna holding layer. Then, the copper foil is processed into an antenna pattern by a subtractive process, for example.

A general printed substrate or polyimide sheet can be used as the antenna holding layer. The relative permittivity $\varepsilon_{r1}$ of the antenna holding layer is preferably not less than 3 and not more than 10.

The thickness of the antenna holding layer is, for example, not less than 5 μm and not more than 50 μm. As the thickness of the antenna holding layer increases, higher rigidity is obtained, and stability of its shape is enhanced. However, the cost increases.

In consideration of the antenna characteristics, a low-profile copper foil with small surface roughness is preferably used as the copper film.

A thickness of the copper film is, for example, not less than 5 μm and not more than 20 μm. As the thickness of the copper film increases, higher rigidity is obtained, and stability of its shape is enhanced. However, the cost increases.

(2) A substrate including the first patch antenna and the ground electrode is fabricated.

For example, an LTCC substrate including the first patch antenna and the ground electrode is fabricated by using the low temperature co-fired ceramic material. The first patch antenna and the ground electrode can be formed in conformity with an electrode formation process that is generally used when fabricating LTCC substrates.

A material having a higher relative permittivity than the materials constituting the antenna holding layer and the inter-antenna layer is selected as the low temperature co-fired ceramic material constituting the substrate layer. The relative permittivity $\varepsilon_{r3}$ of the substrate layer positioned between the first patch antenna and the ground electrode is preferably not less than 5 and not more than 20.

The thicknesses of the first patch antenna and the ground electrode are each, for example, not less than 5 μm and not more than 30 μm. As the thicknesses of the first patch antenna and the ground electrode increase, the stability of their shapes is enhanced. However, delamination from ceramic is more likely to occur.

Copper or silver can be used as materials of the first patch antenna and the ground electrode. The materials of the first patch antenna and the ground electrode may be the same as or different from the material of the second patch antenna.

(3) The antenna holding layer, the inter-antenna layer, and the substrate are laminated.

When laminating the antenna holding layer, the inter-antenna layer, and the substrate, they are adjusted such that the positions of the first patch antenna and the second patch antenna are aligned with each other. One of the first patch antenna and the second patch antenna may have a larger size than the other. In such a case, the degradation of the antenna characteristics can be suppressed even if misalignment occurs between the first patch antenna and the second patch antenna.

For example, a film containing, as a main ingredient, a dielectric material such as the above-mentioned resin material can be used as the inter-antenna layer. The relative permittivity $\varepsilon_{r2}$ of the dielectric material is preferably not less than 1.5 and not more than 3 and more preferably not less than 1.5 and less than 3.

The thickness of the inter-antenna layer is changed in accordance with a target frequency.

The antenna holding layer, the inter-antenna layer, and the substrate are pressure-bonded together under pressing conditions (temperature and pressure) at which the material constituting the inter-antenna layer can develop adhesion force. If necessary, an adhesive may be used to ensure bonding force between the members. Furthermore, a cushioning material may be placed in a pressure-bonding jig to prevent the substrate from being broken by the pressure applied during the press-bonding.

(4) Protection for the second patch antenna is made.

In order to protect the second patch antenna, a resist may be laminated on the second patch antenna, or a coating may be plated on the second patch antenna.

(5) The electronic component is mounted.

The electronic component, such as an IC, is mounted to a principal surface of the substrate on the opposite side to the antenna-formed surface. The electronic component can be mounted by using a general mounting process.

(6) Sealing with resin is performed.

In order to protect the electronic component, a mount surface is sealed with resin by using a sealing material. A general molding technique can be used to seal the mount surface with the resin. A general molding material, such as a combination of epoxy resin and silica filler, can be used as the sealing material.

(7) The outer terminals are formed.

Via holes for the outer terminals are formed through the sealing material by using a laser, for example. A conductive paste is filled into the formed via holes and solidified. If necessary, a coating is plated on a surface of the conductive paste.

(8) The substrate is cut into pieces.

If necessary, the substrate after the sealing is cut into individual pieces. For example, a dicer or a laser can be used to cut the substrate.

(9) Products are subjected, if necessary, to cleaning, printing, measurement, visual inspection, and packing, and are then shipped.

Second Embodiment

[Antenna-Mounted Substrate]

An antenna-mounted substrate according to a second embodiment of the present disclosure will be described below. In the second embodiment of the present disclosure, an inter-antenna layer has a cavity portion and a support portion, and when viewed in a section perpendicular to a thickness direction of the inter-antenna layer, the support portion divides the cavity portion into a plurality of regions or is disposed as a plurality of support portions scattered in the cavity portion.

Figure 3:
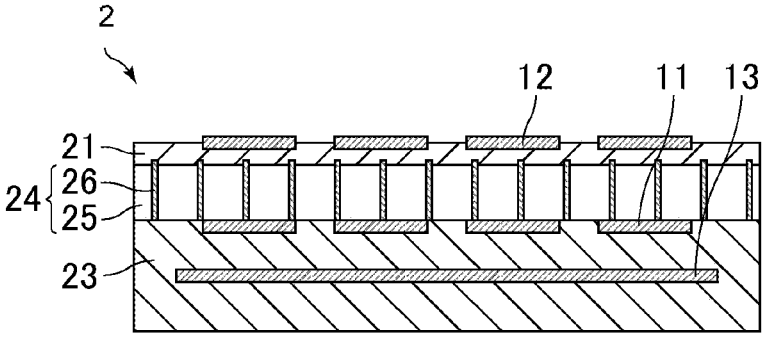
FIG. 3 is a sectional view schematically illustrating an example of an antenna-mounted substrate according to a second embodiment of the present disclosure.

FIG. 3 is a sectional view schematically illustrating an example of the antenna-mounted substrate according to the second embodiment of the present disclosure.

The antenna-mounted substrate 2 illustrated in FIG. 3 includes a first patch antenna 11, a second patch antenna 12, and a ground electrode 13. The second patch antenna 12 is disposed to face one principal surface (upper principal surface in FIG. 3) of the first patch antenna 11, and the ground electrode 13 is disposed to face the other principal surface (lower principal surface in FIG. 3) of the first patch antenna 11.

The antenna-mounted substrate 2 illustrated in FIG. 3 further includes an antenna holding layer 21 that holds the second patch antenna 12, an inter-antenna layer 24 that is positioned between the first patch antenna 11 and the second patch antenna 12, and a substrate layer 23 that is positioned between the first patch antenna 11 and the ground electrode 13, those three layers being positioned in the mentioned order. The inter-antenna layer 24 has a cavity portion 25 and a support portion 26.

The antenna-mounted substrate 2 illustrated in FIG. 3 has the same structure as that of the antenna-mounted substrate 1 illustrated in FIG. 1 except for the structure of the inter-antenna layer 24. Accordingly, the detailed description of the structure other than the inter-antenna layer 24 is omitted. Although not illustrated in FIG. 3, various wirings are formed in the antenna-mounted substrate 2 as required.

While, in the antenna-mounted substrate 2 illustrated in FIG. 3, the support portion 26 is partly buried in the antenna holding layer 21, it is not always needed to be buried in the antenna holding layer 21. Furthermore, the support portion 26 may be partly buried in the substrate layer 23. With the support portion 26 being partly buried in the antenna holding layer 21 or the substrate layer 23, bonding force of the support portion 26 is increased. In addition, variations in height of the support portion 26 can be reduced.

Figure 4:
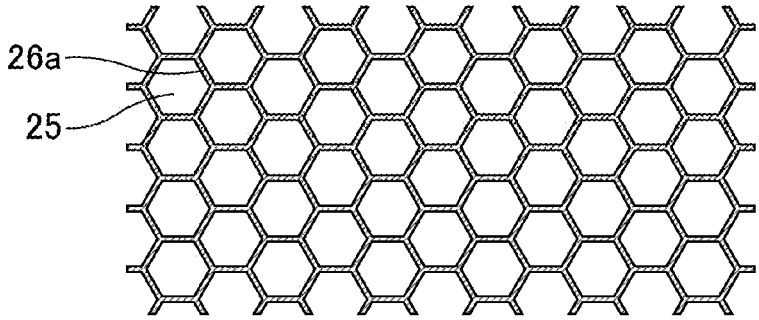
FIG. 4 is a sectional view schematically illustrating an example of an inter-antenna layer in the second embodiment of the present disclosure.
Figure 5:
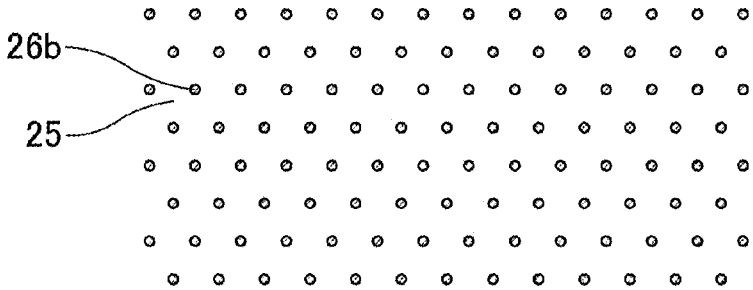
FIG. 5 is a sectional view schematically illustrating another example of the inter-antenna layer in the second embodiment of the present disclosure.

FIG. 4 is a sectional view schematically illustrating an example of the inter-antenna layer in the second embodiment of the present disclosure. FIG. 5 is a sectional view schematically illustrating another example of the inter-antenna layer in the second embodiment of the present disclosure. It is to be noted that FIGS. 4 and 5 illustrate the section perpendicular to the thickness direction of the inter-antenna layer.

In FIG. 4, a support portion 26*a* divides the cavity portion 25 into a plurality of regions. On the other hand, in FIG. 5, a plurality of support portions 26*b* are scattered in the cavity portion 25.

In the antenna-mounted substrate according to the second embodiment of the present disclosure, the inter-antenna layer has the cavity portion and the support portion. When viewed in the section perpendicular to the thickness direction of the inter-antenna layer, the support portion divides the cavity portion into a plurality of regions or is disposed as a plurality of support portions scattered in the cavity portion. Furthermore, a relation of $\varepsilon_{r3}>\varepsilon_{r1}\geq\varepsilon_{r2}$ is satisfied on an assumption that a relative permittivity of the antenna holding layer is denoted by $\varepsilon_{r1}$, a relative permittivity of the inter-antenna layer is denoted by $\varepsilon_{r2}$, and a relative permittivity of the substrate layer is denoted by $\varepsilon_{r3}$.

In the second embodiment of the present disclosure, as in the first embodiment, antenna characteristics can be improved by relatively setting the relative permittivity of the inter-antenna layer positioned between the first patch antenna and the second patch antenna to be relatively minimal. In the second embodiment, since the cavity portion is defined in the inter-antenna layer with the support portion supporting the spaced antennas, the rigidity of the substrate can be ensured while the relative permittivity of the inter-antenna layer is reduced. As a result, the antenna characteristics can be stabilized, and a warp of the substrate can be suppressed.

Moreover, as in the first embodiment, by setting the relative permittivity of the substrate layer positioned between the first patch antenna and the ground electrode to be relatively maximal, the thickness of the antenna-mounted substrate can be reduced. In the second embodiment, since the cavity portion with the relative permittivity of about 1 is disposed between the antennas, the thickness of the inter-antenna layer can be further reduced in comparison with that in the first embodiment. Accordingly, the second embodiment is more advantageous in reducing the thickness of the antenna-mounted substrate.

In the second embodiment of the present disclosure, a relation of $\varepsilon_{r3}>\varepsilon_{r1}>\varepsilon_{r2}$ may be satisfied, or a relation of $\varepsilon_{r3}>\varepsilon_{r1}=\varepsilon_{r2}$ may be satisfied.

In the second embodiment of the present disclosure, the relative permittivity $\varepsilon_{r1}$ of the antenna holding layer, the material constituting the antenna holding layer, and the thickness of the antenna holding layer are similar to those in the first embodiment.

In the second embodiment of the present disclosure, the relative permittivity $\varepsilon_{r2}$ of the inter-antenna layer is preferably not less than 1.5 and not more than 2.5.

The relative permittivity $\varepsilon_{r2}$ of the inter-antenna layer having the cavity portion and the support portion is determined as follows. Assuming that a relative permittivity of the cavity portion constituting the inter-antenna layer is denoted by $\varepsilon_{r21}$ ($\varepsilon_{r21}\approx 1$ because of air), a relative permittivity of the support portion is denoted by $\varepsilon_{r22}$, a ratio of an area occupied by the cavity portion to an area of one of the two patch antennas is denoted by $x_1$, and a ratio of an area occupied by the support portion to the one antenna is denoted by $x_2$, the relative permittivity $\varepsilon_{r2}$ of the inter-antenna layer can be determined by $\varepsilon_{r21}\times x_1+\varepsilon_{r22}\times x_2$.

In the second embodiment of the present disclosure, the cavity portion is not always needed to be formed over an entire space between the first patch antenna and the second patch antenna. For example, a dielectric layer may be defined in a part of the space between both the antennas, such as in a peripheral edge portion of the substrate layer.

In the second embodiment of the present disclosure, as illustrated in FIG. 4, when the support portion divides the cavity portion into the plurality of regions, a shape of the support portion when viewed in the section perpendicular to the thickness direction of the inter-antenna layer is preferably a honeycomb shape.

In this Description, the term "honeycomb shape" stands for not only the so-called honeycomb shape in which many hexagonal cavity portions are arrayed side by side with the support portion interposed between the adjacent cavity portions as illustrated in FIG. 4, but also shapes in which many cavity portions having square, rectangular, other polygonal, circular, elliptic, or the like shape are arrayed side by side. In other words, the honeycomb shape includes shapes having many cavity portions arrayed side by side with the support portion interposed between adjacent two of the cavity portions regardless of the shape of each cavity portion. The honeycomb shape is further assumed to include shapes having many cavity portions with different shapes and/or sizes arrayed side by side with the support portion interposed between adjacent two of the cavity portions.

In the second embodiment of the present disclosure, when the plurality of support portions are scattered in the cavity portion as illustrated in FIG. 5, each support portion may have, for example, a columnar shape such as a circular or rectangular columnar shape, a conical shape such as a circular or rectangular conical shape, or a truncated conical shape such as a circular or rectangular truncated conical shape.

When the plurality of support portions are scattered in the cavity portion, the support portions may be regularly arranged. The regular arrangement of the support portions can suppress variations in characteristics between the antennas. As an alternative, the support portions may be irregularly arranged. The sizes, shapes, and so on of the support portions may be all the same or different from one another.

In the second embodiment of the present disclosure, the support portion constituting the inter-antenna layer may be preferably made of a ceramic material. It is also preferable that the support portion constituting the inter-antenna layer is made of a resin material.

The ceramic material constituting the support portion is, for example, the low temperature co-fired ceramic material described in the first embodiment. The resin material constituting the support portion is, for example, thermosetting resin such as epoxy resin or phenol resin, or thermosetting polyimide.

In the second embodiment of the present disclosure, the thickness of the inter-antenna layer is not limited to a particular value, but it is preferably not less than 150 μm and not more than 250 μm.

In the second embodiment of the present disclosure, the relative permittivity $\varepsilon_{r3}$ of the substrate layer, the material constituting the substrate layer, and the thickness of the substrate layer are similar to those in the first embodiment.

[Antenna Module]

An antenna module according to the second embodiment of the present disclosure includes an antenna-mounted substrate and an electronic component mounted to the antenna-mounted substrate, the antenna-mounted substrate being the same as that according to the second embodiment of the present disclosure.

Figure 6:
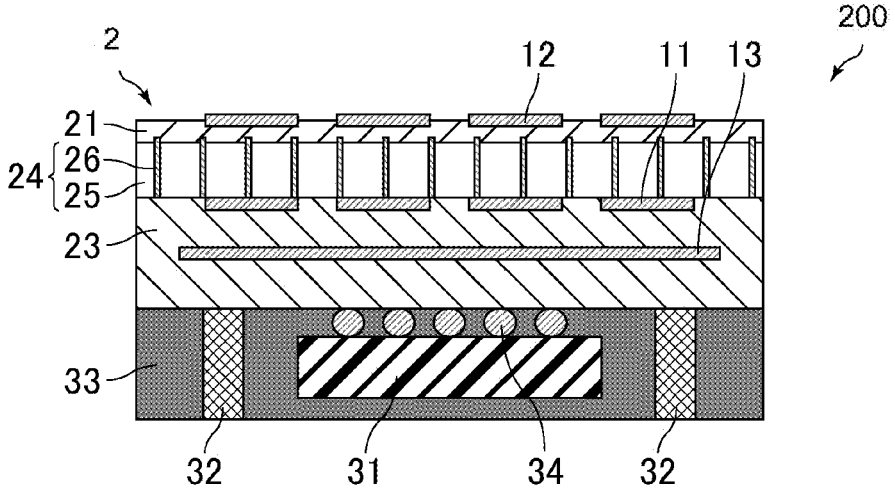
FIG. 6 is a sectional view schematically illustrating an example of an antenna module according to the second embodiment of the present disclosure.

FIG. 6 is a sectional view schematically illustrating an example of the antenna module according to the second embodiment of the present disclosure.

The antenna module 200 illustrated in FIG. 6 includes an antenna-mounted substrate 2 in which an antenna is mounted to one principal surface of a circuit substrate, and an electronic component 31 mounted to the antenna-mounted substrate 2. The antenna-mounted substrate 2 is constituted as per described with reference to FIG. 3.

In the antenna module 200 illustrated in FIG. 6, the electronic component 31 is mounted to the other principal surface of the circuit substrate, i.e., a principal surface on the opposite side to the principal surface on the side to which the antenna is mounted. The electronic component 31 is mounted to the circuit substrate with a bonding material 34, such as a solder, interposed therebetween.

In the antenna module 200 illustrated in FIG. 6, outer terminals 32 are disposed on the other principal surface of the circuit substrate, and the electronic component 31 and the outer terminals 32 are sealed by a sealing material 33.

The antenna module according to the second embodiment of the present disclosure has the same structure as that of the antenna module according to the first embodiment of the present disclosure except for the structure of the antenna-mounted substrate. Accordingly, the description regarding the details of the electronic component, the outer terminals, and the sealing material is omitted.

The antenna-mounted substrate and the antenna module according to the second embodiment of the present disclosure are preferably manufactured as follows.

(1) The second patch antenna and the antenna holding layer are fabricated as in the first embodiment of the present disclosure.

(2) A substrate including the first patch antenna and the ground electrode is fabricated as in the first embodiment of the present disclosure.

(3) The support portion is formed on the substrate.

For example, the support portion having the honeycomb shape is formed by applying a ceramic paste with inkjet printing.

When the substrate is fabricated in above (2) by using the low temperature co-fired ceramic material, the substrate may be fired after applying the ceramic paste (called co-firing), or the ceramic paste may be applied and fired after firing the substrate (called post-firing). In the case of the co-firing, the firing cost can be reduced. In the case of the post-firing, different types of materials can be used because firing conditions can be set for each of the substrate and the support portion.

A ceramic material contained in the ceramic paste may be the same as or different from that constituting the substrate. In consideration of the antenna characteristics, a ceramic material having a low permittivity is preferably used.

When forming the support portion, a resin paste may be applied and solidified instead of the ceramic paste. In the case of using the resin paste, the resin paste can be solidified at a lower temperature than in the case of using the ceramic material. Therefore, the substrate is less likely to warp, and the substrate with higher dimensional accuracy can be obtained.

The support portion may be formed by using a dispenser, for example, instead of inkjet. Using the dispenser can shorten a cycle time and realize cost reduction.

(4) The antenna holding layer and the substrate including the support portion are laminated.

When laminating the antenna holding layer and the substrate, they are adjusted such that the positions of the first patch antenna and the second patch antenna are aligned with each other.

The support portion is preferably pressed to be partly buried in the antenna holding layer as illustrated in FIG. 3.

The thickness of the inter-antenna layer is changed in accordance with a target frequency.

(5) The second patch antenna may be protected in a similar manner to that in the first embodiment of the present disclosure.

(6) The electronic component is mounted in a similar manner to that in the first embodiment of the present disclosure.

(7) The outer terminals are formed.

For example, pins for the outer terminals are disposed on the substrate at the same time as when the electronic component is mounted.

(8) Sealing with resin is performed in a similar manner to that in the first embodiment of the present disclosure.

(9) After the sealing, the surface of a sealing material is ground to make the pins for the outer terminals exposed. If necessary, a coating is plated on the surfaces of the pins.

(10) If necessary, the substrate is cut into individual pieces, and the products are shipped after being subjected to cleaning, printing, measurement, visual inspection, and packing as in the first embodiment of the present disclosure.

Other Embodiments

The antenna-mounted substrate and the antenna module according to the present disclosure are not limited to those described in the above embodiments, and can be variously improved or modified within the scope of the present disclosure regarding, for example, the structure of the antenna-mounted substrate and the structure of the antenna module.

For example, in the first embodiment of the present disclosure, the outer terminals may be formed by the method described in the second embodiment. Similarly, in the second embodiment of the present disclosure, the outer terminals may be formed by the method described in the first embodiment.

1, 2 antenna-mounted substrate
11 first patch antenna
12 second patch antenna
13 ground electrode
21 antenna holding layer
22, 24 inter-antenna layer
23 substrate layer
25 cavity portion
26, 26*a*, 26*b* support portion
31 electronic component
32 outer terminal
33 sealing material
34 bonding material
100, 200 antenna module

The invention claimed is:

1. An antenna-module comprising:
an antenna-mounted substrate in which an antenna array is mounted to a first surface of a circuit substrate; and
an electronic component mounted to the antenna-mounted substrate;
wherein the antenna-mounted substrate comprises:
a first patch antenna;
a second patch antenna disposed to face one principal surface of the first patch antenna;
a ground electrode disposed to face one other principal surface of the first patch antenna;
an antenna holding layer that holds the second patch antenna;
an inter-antenna layer that is positioned between the first patch antenna and the second patch antenna; and
a substrate layer that is positioned between the first patch antenna and the ground electrode, the antenna holding layer, the inter-antenna layer, and the substrate layer being sequentially positioned in a stacked order starting from the second patch antenna toward the ground electrode,
wherein the inter-antenna layer is made of a dielectric material, and
a relation of $\varepsilon_{r3}>\varepsilon_{r1}>\varepsilon_{r2}$ is satisfied on an assumption that a relative permittivity of the antenna holding layer is denoted by $\varepsilon_{r1}$, a relative permittivity of the inter-antenna layer is denoted by $\varepsilon_{r2}$, and a relative permittivity of the substrate layer is denoted by $\varepsilon_{r3}$.

2. The antenna module according to claim 1, wherein the dielectric material is a resin material.

3. The antenna module according to claim 1,
wherein a thickness of the inter-antenna layer is larger than the thickness of the substrate layer, and the thickness of the substrate layer is larger than the thickness of the antenna holding layer.

4. The antenna module according to claim 1, wherein the electronic component is mounted to a second surface of the circuit substrate.

5. An antenna module comprising:
an antenna-mounted substrate in which an antenna array is mounted to a circuit substrate; and
an electronic component mounted to the antenna-mounted substrate;
wherein the antenna-mounted substrate comprises:
a first patch antenna;
a second patch antenna disposed to face one principal surface of the first patch antenna;
a ground electrode disposed to face one other principal surface of the first patch antenna;
an antenna holding layer that holds the second patch antenna;
an inter-antenna layer that is positioned between the first patch antenna and the second patch antenna; and
a substrate layer that is positioned between the first patch antenna and the ground electrode, the antenna holding layer, the inter-antenna layer, and the substrate layer being sequentially positioned in a stacked order starting from the second patch antenna toward the ground electrode;

wherein the inter-antenna layer has a cavity portion and a support portion;

when viewed in a section perpendicular to a thickness direction of the inter-antenna layer, the support portion divides the cavity portion into a plurality of regions or is disposed as a plurality of support portions scattered in the cavity portion, and a relation of $\varepsilon_{r3}>\varepsilon_{r1}>\varepsilon_{r2}$ is satisfied on an assumption that a relative permittivity of the antenna holding layer is denoted by $\varepsilon_{r1}$, a relative permittivity of the inter-antenna layer is denoted by $\varepsilon_{r2}$, and a relative permittivity of the substrate layer is denoted by $\varepsilon_{r3}$.

6. The antenna module according to claim 5, wherein a thickness of the inter-antenna layer is larger than the thickness of the substrate layer, and the thickness of the substrate layer is larger than the thickness of the antenna holding layer.

7. The antenna module according to claim 5, wherein, when viewed in the section perpendicular to the thickness direction of the inter-antenna layer, the support portion has a honeycomb shape dividing the cavity portion into the plurality of regions.

8. The antenna module according to claim 5, wherein the support portion is made of a ceramic material.

9. The antenna module according to claim 6, wherein the support portion is made of a ceramic material.

10. The antenna module according to claim 5, wherein the support portion is made of a resin material.

11. The antenna to claim 7, wherein the support portion is made of a resin material.

* * * * *